United States Patent [19]

Baugh

[11] Patent Number: 4,779,688

[45] Date of Patent: Oct. 25, 1988

[54] MUD SAVER VALVE

[76] Inventor: Benton F. Baugh, 14626 Oak Bend, Houston, Tex. 77079

[21] Appl. No.: 888,259

[22] Filed: Jul. 23, 1986

[51] Int. Cl.[4] ..... E21B 21/10

[52] U.S. Cl. ..... 175/218; 137/493; 137/508; 166/325

[58] Field of Search ..... 175/218, 232, 234, 237, 175/317; 166/325, 329; 137/493, 508

[56] References Cited

U.S. PATENT DOCUMENTS

| | | | |
|---|---|---|---|
| 3,698,426 | 10/1972 | Litchfield et al. | 166/325 X |
| 3,750,749 | 8/1973 | Giroux | 175/218 X |
| 4,128,108 | 12/1978 | Parker et al. | 137/508 X |
| 4,248,264 | 2/1981 | Handsell et al. | 137/515 X |
| 4,364,407 | 12/1982 | Hillard | 166/325 X |
| 4,625,755 | 12/1986 | Reddoch | 166/325 X |

*Primary Examiner*—Stephen J. Novosad
*Assistant Examiner*—David J. Bagnell

[57] ABSTRACT

A mud valve assembly with a valve means with a first sealing surface and a piston means with a second sealing surface which seals against the first sealing surface such that the piston and the first seal surface move downward in response to pressure from above which exceeds a predetermined pressure level and the valve means and the second sealing surface move upwards in response to pressure from below the valve assembly; and the valve means with the second sealing surface can be retrieved from the bore of the drill pipe and reinstalled into the bore of the drill pipe without removing the mud valve assembly from the drill pipe.

16 Claims, 2 Drawing Sheets

MUD SAVER VALVE

BACKGROUND OF THE INVENTION

The field of invention of this valve pertains to valves and more particularly to a valve assembly of the type known as a kelly foot valve or a mud saver valve used in the rotary system for drilling oil wells.

Conventional drilling of oil wells uses the a drill string or sections of drill pipe to pump drilling mud down to a drilling bit at the bottom of the hole being drilled. The drill string also typically is rotated to provide rotary power to the drilling bit at the bottom of the hole. As the hole is progressively drilled deeper and deeper, sections of drill pipe are added to the drill string to allow continued drilling. These sections are typically 30 feet long. The wells are typically from 1000 to 20,000 feet deep. The drill string is supported in the rotary table of the rig and the upper drive section or kelly is unscrewed. When it is unscrewed, the mud in the kelly and the hose connecting the top of the kelly to the other piping on the rig pours out onto the rig floor.

The pouring of the drilling mud onto the rig floor is expensive because of the cost of the mud and is dangerous to the rig crew as it makes the floor slippery.

Prior art valves have been inserted into the drill string at the foot or lower end of the kelly with different characteristics and with different degrees of success. One solution has been to place a slim O.D. ball valve in the string which is operated manually by the crew.

Other valves have been added which operate automatically based upon bore pressure or upon throttling of the fluid across the valve. These valves and the valve of the present invention are typically installed in a sub called a Kelly Saver. The term Kelly Saver comes from the fact that the section of square pipe at the top of the drill pipe which is engaged by the rotary table to turn the drill pipe is call the Kelly. Each time 30 feet more of the well is drilled, the connection at the bottom of the Kelly is unscrewed and a joint of drill pipe is added to allow further drilling. This causes high wear and reduced life on the relatively expensive Kelly. A short inexpensive section of pipe is normally added to the bottom of the Kelly to take this wear and is typically called a Kelly Saver.

Prior art valves characteristically do not allow the bore thru the valve to be opened for service access down into the string of drill pipe and then put back into service without having to disassembly the mud saver valve from the drill string to put it back together. Some of the alternatives, i.e. U.S. Pat. Nos. 3,698,411 and 3,965,980 require breaking a cap portion at the top of the valve to allow such service. U.S. Pat. No. 4,128,108 discloses a mud saver valve which requires that a pin be sheared to allow such service. U.S. Pat. No. 3,331,385 discloses a valve in which an extra part is added with special running tools to allow opening and then plugging the bore. This provides the limitations of making the hole available for servicing smaller, adding extra parts, and not allowing the critical wear surfaces to be retrieved easily for inspection and/or replacement.

A second problem associated with prior art valves is that of allowing any pressure build-up below the mud saver valve to be sensed by pressure gages above the mud saver valve. This might occur when the mud in not being pumped. If unstable well conditions exist in which a blowout threatens, watching the pressure in the drill pipe above this valve is critical in the process of knowing how to control the well. Typical prior art valves such as those listed above include added components to act as check valves to allow flow in the direction going up the well.

SUMMARY OF THE INVENTION

The object of the present invention is provide a mud valve assembly including a valve means which seals against a piston means and prevents flow out of the kelly portion of the drill pipe string above the rotary table or working level on a rotary drilling oil rig under the low head pressures associated with unscrewing the drill pipe at the rotary table or working level, but will caused the piston to move down and allow free flow under the higher pressures and flow rates which normally exist under drilling conditions, which will allow the valve means to move up freely to vent pressure from below the valve means to the area above the valve means for pressure sensing by rig personnel, and further which will allow the complete removal and reinstallation of the valve means with its seal area for downhole servicing work thru the drill string without having to remove the mud valve assembly from the drill pipe.

DESCRIPTION OF THE PREFERRED EMBODIMENT

Figure 1:
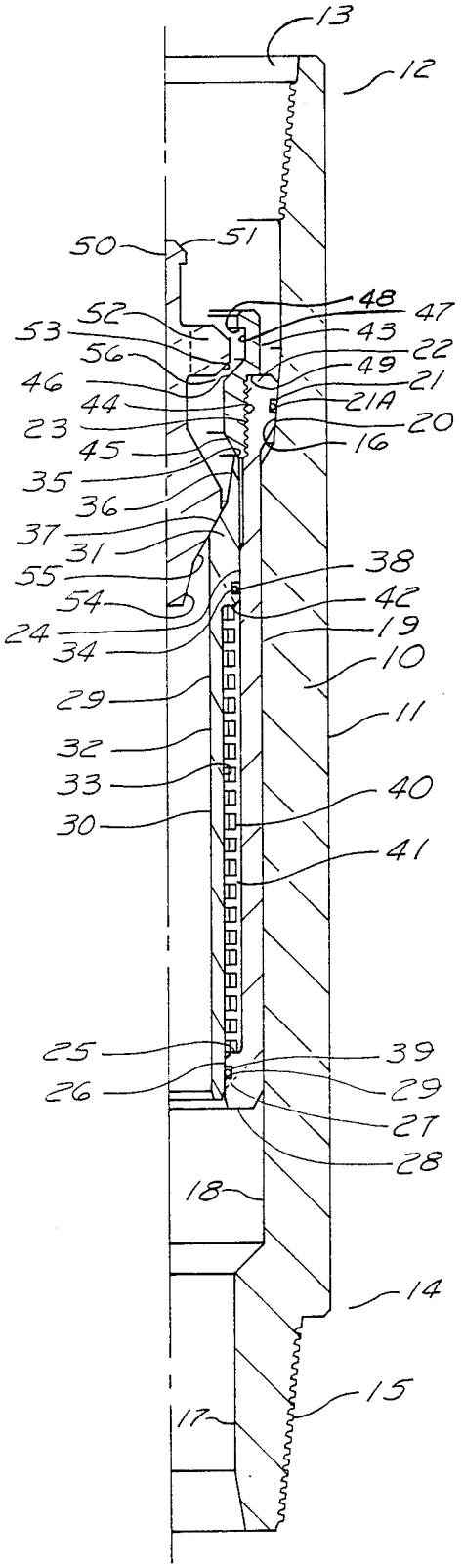
FIG. 1 is a quarter section of the mud valve assembly of this invention in the first position which is closed and not allowing flow thru the valve.

Referring now to FIG. 1, the mud valve assembly 10, is contained within a section of drill pipe 11 which is normally called a Kelly Saver. The upper end of the Kelly Saver 12 has a female drill pipe thread 13 for connection to the Kelly and the lower end 14 has a male drill pipe thread 15 for connection to the top of the string of drill pipe extending down into the well being drilled.

A tapered shoulder 16 is in the upper end of the Kelly Saver 11 for supporting the mud saver valve 10. The bore 17 of the Kelly Saver 11 is the normal thru bore which would exist in a sub of this type, and the bore 18 is an enlarged bore in the sub machined out to accommodate the mud saver valve assembly 10.

Tubular body 19 includes and outer tapered shoulder portion 20 which lands on the tapered shoulder 16. Tapered shoulder 20 includes a seal groove 21 and a seal ring 21A which seal against the tapered shoulder 16. Tapered body 19 also includes a top shoulder 22, an internal female thread 23, a seal bore 24, an internal shoulder 25, a reduced bore 26, a seal groove 27, and a lower end 28.

Piston means 29 includes a long straight portion 30 and an enlarged portion 31. The bore 32 of the piston means 29 preferrably matches the bore 17 of the Kelly Saver 11. Piston means 29 further provides a seal surface 33, a seal groove 34, an upper shoulder 35, a first tapered surface 36, and a second tapered surface 37 which will also be called the first seal area 37.

Seal ring 38 fits into seal groove 34 and seals against seal bore 24. Seal ring 39 fits into seal groove 29 and seals against seal surface 33.

Spring 40 fits into the cavity 41 between the tubular body 19 and the piston means 29 and pushes up against shoulder 42 on the piston means 29 and reacts against the shoulder 25 on the tubular body 19. The cavity 41 is a sealed cavity with the difference in the areas of the seal bore 33 and the seal bore 24 acting as a piston area subjected to the pressures within the drill pipe. Under sufficient pressure, this piston area will cause the piston means to move against the spring loading and move down until a stop is encountered. In the case of the preferred embodiment, the spring 40 is made of a square wire and stops the movement of the piston means 19 when it reaches stack height.

Stop body 43 provides a male thread 44 to engage the female thread 23 of the tubular body 19, a lower tapered shoulder 45, an upper tapered shoulder 46, and internal profile 47 and an internal shoulder 48. The lower tapered shoulder 45 is engaged by the upper shoulder 35 of the piston means 29 to act as the upper stop in the movement of the piston means 29. The internal profile 47 with the internal shoulder 48 is intended for removal of the valve assembly from the Kelly Saver 11. Shoulder 49 provides a stop shoulder against shoulder 22 when screwing the stop body 43 into the tubular body 19.

Valve means 50 provides retrieval profile 51, arms 52, shoulders 53 on the arms 52, a first tapered surface 54, and a second tapered surface 55 which will also be referred to as second sealing surface 55. Seal surface 55 is contacting and sealing against seal surface 37 in the position as shown. In this case sealing refers to preventing of substantial flow and is not intended to require "drop tight" sealing. It is relevant to notice that when the connection 15 is unscrewed, all of the fluids inside the valve are going to spill out. It is the additional gallons above the valve means 19 in the Kelly which this valve is intended to keep from spilling on the rig floor.

As pressure in increased from the top, the combination of the valve means 50 and the piston means 29 will move down until the gap 56 between the shoulders 53 and 46 is closed. At that time the valve means 50 is prevented from moving down further. Additional pressure will cause the piston means 29 to move down against the spring force and therefore cause a separation in the seal surfaces 55 and 37. As the combination of pressure and flow increase, the piston means 29 will be moved fully down to its lower position and the valve will be fully open.

When the flow is stopped and the pressure is vented, the valve means and piston means will return to the position as shown on this figure.

Figure 2:
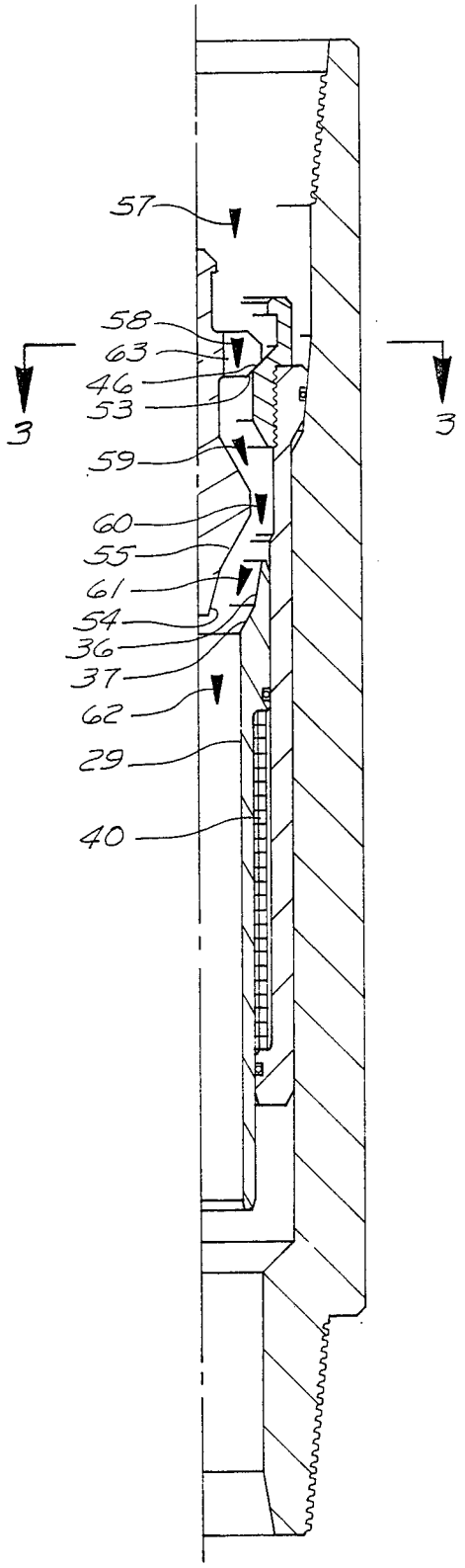
FIG. 2 is a quarter section of the mud valve assembly in the position in which it will assume under flowing conditions.
Figure 3:
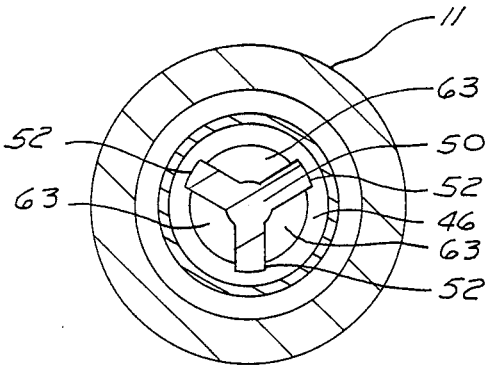
FIG. 3 is a cross section thru the mud valve assembly taken thru the lines 3—3 on figure no. 2.

Referring now to FIG. 2, arrows 57 thru 62 indicate the flow path thru the assembly when under flowing conditions. The piston means 29 has moved fully down and the spring 40 is at its stack height. The valve means 50 has landed at its lowest position with the shoulder 53 contacting the shoulder 46.

Arrow 58 is is shown going thru the flow area 63 between the arms 52 of the valve means 50. The double tapers 36 and 37 and the double tapers 54 and 55 are shown to be instrumental in providing a relatively smooth flow path thru the valve to minimize turbulence and thereby promote longer service life without erosion.

The force of the flow plus the pressure against the piston area at the top of the piston means 29 are keeping the piston means in the fully opened position. When these forces diminish below a minimum level, the piston means will return to the position as shown in the FIG. 1.

Referring now to figure no. 3, valve means 50 is shown with the flow areas 63 between the arms 52. This illustrates how the shoulder 46 can be contacted by the shoulder 53 (not shown) as a stop and still allow ample area for flow past the valve member 50.

Figure 4:
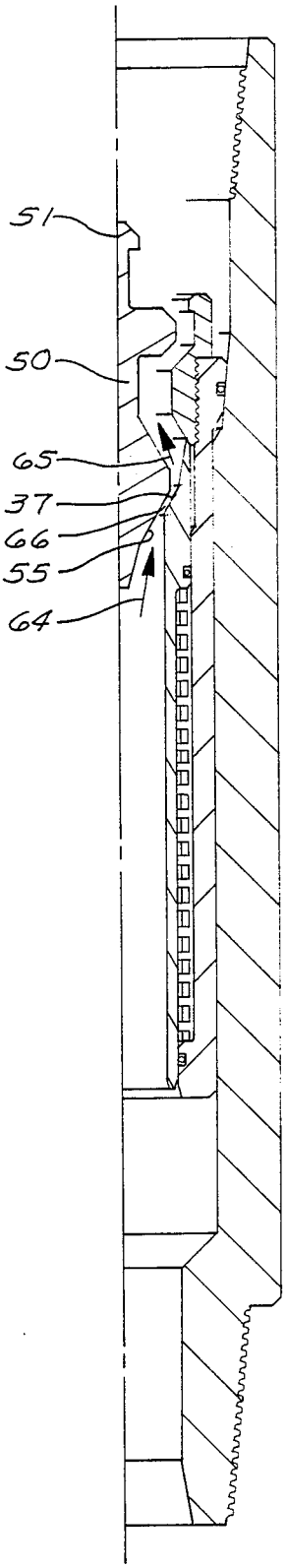
FIG. 4 is a quarter section of the mud valve assembly showing flow in the reverse direction from below the valve means to above the valve means.

Referring now to FIG. 4, flow of fluids is shown to be coming up from the drill string into the kelly by arrows 64 and 65. This flow has lifted the valve means 50 up so that the second sealing surface 55 has been separated from the first sealing surface 37 and caused a gap 66.

The valve means 50 will stay in this slightly elevated position as long as flow exists from the drill string. This is essential so that the drilling personnel on the rig floor can monitor the pressures within the well when the pumps are not pumping as in normal drilling.

In like manner the valve means 50 can be simply retrieved from the bore by tools readily available on the drilling rigs which will engage the retrieval profile 51.

The present embodiment reflects a sealed spring cavity 41 which provides the benefits of fully opening the valve due to pressure even at low flow rates and keeps the spring area clean and free from drilling mud. The valve can also be manufactured without the lower seal 39 being in place. This style depends strictly upon throttling across the seat area to provide the force to keep the valve open and would be completely workable, although it would tend to have a shorter service life.

The foregoing disclosure and description of this invention are illustrative and explanatory thereof, and various changes in the size, shape, and materials, as well as the details of the illustrated construction may be made without departing from the spirit of the invention.

I claim:

1. In a valve for retaining mud in the kelly of a rotary drilling rig for oil and gas wells and the such like when the drill pipe is disconnected therefrom, the combination comprising:

a tubular body adapted to be inserted into an enlarged portion of the drill pipe, a lower shoulder portion of said tubular body, a seal bore portion of said tubular body, an external shoulder portion of said tubular body adapted to land on and be supported by a shoulder within said drill pipe, stop body means, attachment means to connect said stop body to said tubular body, a downward facing stop shoulder, an upward facing stop shoulder, piston means within said tubular body, lifting means urging said piston means within said tubular body up against said downward facing shoulder for a first position, an upward facing first seat area on said piston means, a valve means having a downward facing second seat area and a downward facing support area, said second seat area contacting said first seat area when said piston means is in said first position in order to prevent flow of fluids from above said valve means to below said valve means at an initial pressure level, whereby said piston means and said valve means are urged downwardly due to increased pressure and flow from above said valve, whereby said downwardly facing shoulder on said valve means contacts said upward facing stop shoulder and is prevented from further downward movement, whereby said second seat means is thereby stopped and said first seat means continues to travel downward to a second position permitting flow from above said valve to below said valve between said first and said second seat areas, such that when said flow is stopped said lifting means will again urge said piston means to said first position with said first seat area contacting said second seat area and therefore sealing off the flow path against said initial pressure level from above, further given that said valve means is responsive to flow of pressure in said drill string from below said assembly to above said valve to move upwardly and pass said pressure between said first seat area and said second seat area.

2. The invention of claim 1, wherein said valve means can be retrieved from said valve and reinstalled without removing said valve from said drill string.

3. The invention of claim 2, wherein said lifting means is a spring made of square wire which is compressed to its stacked height by downward movement of said piston means and therefore stops the travel of the piston means to establish said second position of said piston means.

4. The invention of claim 1, wherein said lifting means is a spring.

5. The invention of claim 4, wherein said spring is a spring made of square wire.

6. The invention of claim 5, wherein said spring made of square wire is compressed to its stacked height by the downward movement of said piston means and therefore stops the travel of the piston means to establish said second position of said piston means.

7. A valve means for application within a mud saver valve assembly of the drill string of a rotary drilling rig having a tubular body, a piston means with an upward facing first sealing area, spring means urging said piston upward to a first position when subjected to a first pressure level from above said valve means, an area on said piston responsive to a second pressure or flow level urging said piston downwardly a distance to a second position when subjected to said second pressure or flow level, and an upwardly facing stop shoulder to be engaged by said valve means, said valve means comprising:

a downward facing second seal area landing on, being supported by, and sealing against said upward facing first seal area to prevent flow from above said valve means to below said valve means at said first pressure level, a downwardly facing shoulder positioned above said upwardly facing stop shoulder which lands on said upwardly facing stop shoulder of said mud saver valve during the downward travel of said piston means supporting said valve means from said first position to said second position causing said valve means with said downward facing second seal area to be stopped and thereby separated from said upward facing first sealing area on said piston means to allow flow therebetween from above said valve means to below said valve means, and the movement of said valve means upwardly under urging of pressure from below said valve member to communicate pressure below said valve member to the space above said valve member, said communication being between said first upward facing seat area and said second downward facing seat area.

8. The invention of claim 7, further comprising an upward facing retrieval profile for retrieving and reinstalling said valve means including said second seating area thru the bore of said drill string, whereby said valve means and said second seal area can be retrieved from said mud saver valve without removing said mud saver valve from said drill string.

9. In a valve for retaining fluids or gases in the kelly of a string of drill pipe on a rotary drilling rig or the such like, the combination comprising:

a tubular body, a piston means, and a valve means, with a first seal area on said piston means and a second seal area on said valve means, said first and second seal areas being in contact in a first position of said valve, said piston means having an upwardly facing piston area being urged downwardly in response to pressure from above said piston means from said first position to a second position and said valve means having a downwardly facing shoulder which lands on an upwardly facing shoulder on said tubular body during the travel of said piston means from said first position to said second position and therefore restricts the valve means to lesser downward movement in response to said pressure from above said valve means than the movement of said piston means thereby separating said first seat area from said second seat area and allowing flow therebetween in the downward direction, said valve means being urged upwardly and said piston means being prevented from moving upwardly in response to pressure from below said valve means thereby separating said first seat area from said second seat area and allowing flow therebetween in the upward direction.

10. The invention of claim 9, wherein said piston is urged upwardly by a spring member preventing said downward movement in response to pressures from above of a first pressure level but allowing said downward movement in response to pressures greater than said first level.

11. The invention of claim 10, wherein said spring member is a spring made of square wire.

12. The invention of claim 11, wherein said spring made of square wire is compressed to its stacked height by the downward movement of said piston means and therefore stops the travel of the piston means to establish said second position of said piston means.

13. The invention of claim 10, wherein said spring member is contained within a sealed area with a piston area exposed to the pressures within the drill pipe such that said pressures above said first pressure level will act against said piston area and completely move said piston to the bottom of its downward movement and thereby fully separate said first seal area from said second seal area and allow flow thru the valve in the upward or downward direction as long as the pressure is maintained.

14. The invention of claim 13, wherein said spring is a spring made of square wire.

15. The invention of claim 14, wherein said spring made of square wire is compressed to its stacked height by the downward movement of said piston means and therefore stops the travel of the piston means to establish said second position of said piston means.

16. The invention of claim 9, wherein said lifting means is a spring made of square wire which is compressed to its stacked height by downward movement of said piston means and therefore stops the travel of the piston means to establish said second position of said piston means

* * * * *